US005697202A

United States Patent [19]

Totilo

[11] Patent Number: 5,697,202

[45] Date of Patent: Dec. 16, 1997

[54] METHOD FOR CARTON PACKAGING

[75] Inventor: Richard E. Totilo, Crystal Lake, Ill.

[73] Assignee: Tetra Laval Holdings & Finance S.A., Buffalo Grove, Ill.

[21] Appl. No.: 800,533

[22] Filed: Feb. 18, 1997

[51] Int. Cl.[6] ..... B65B 35/50

[52] U.S. Cl. ..... 53/475; 53/447; 53/449

[58] Field of Search ..... 229/915.1; 206/499, 206/526; 53/171, 244, 247, 447, 449, 475, 540

[56] References Cited

U.S. PATENT DOCUMENTS

| | | | |
|---|---|---|---|
| 3,031,811 | 5/1962 | Monroe et al. | 53/247 X |
| 3,082,584 | 3/1963 | Schmid | 53/171 X |
| 3,172,594 | 3/1965 | Kuchenbecker | 229/915.1 X |
| 3,273,304 | 9/1966 | Winter et al. | 53/244 X |
| 3,552,633 | 1/1971 | Ketler | 229/915.1 X |
| 3,783,579 | 1/1974 | Howe | 53/447 X |
| 3,784,082 | 1/1974 | Hurlock | 229/915.1 X |
| 3,914,921 | 10/1975 | Doran et al. | 53/247 X |
| 4,568,018 | 2/1986 | Husnik | 229/915.1 X |

*Primary Examiner*—Daniel Moon
*Attorney, Agent, or Firm*—Welsh & Katz, Ltd.

[57] ABSTRACT

A method for container packaging includes the steps of providing a plurality of square profile individual packages, each package having an empty 47 mm by 47 mm square profile, and a full profile between about 50 mm by 50 mm and 51 mm by 51 mm, a relatively rigid bottom, and a peaked gable top having a rigid, linearly disposed, upwardly extending sealing portion defined by a pair of sloped top portion walls. The method includes providing a packing storage unit for storing the individual packages. The storage unit has an inside storage dimension of between about 6.6 to 6.8 times the length of a container wall when the container is empty and 6.0 to 6.4 times the length of the container wall when the container is filled. The containers are disposed in a lower layer within the packing storage unit, and are positioned in a 6 by 6 matrix having a first set of six parallel linear arrays and a second set of six parallel linear arrays. The first and second sets of linear arrays are positioned perpendicular to one another. The packages are positioned wherein each of the linear sealing portions is disposed along one of the first and second sets of parallel linear arrays, and the face portion of each package of each array is disposed in an orientation common with the face portion of other packages in the same array. The method includes disposing an upper layer of individual packages within the packing storage on the first layer with the bottom of the packages of the second layer positioned on the linear sealing portions of a corresponding individual package in the lower layer. The packages in the upper layer are positioned and oriented identical to the packages of the lower layer.

8 Claims, 1 Drawing Sheet

FIG. 1
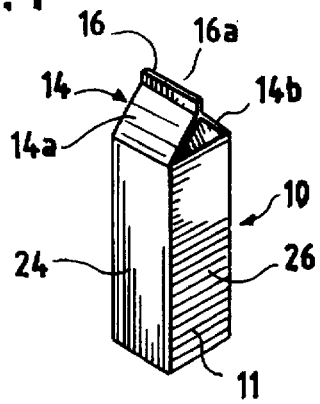
FIG. 2
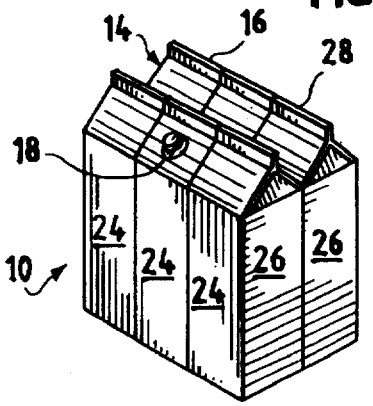
FIG. 3A
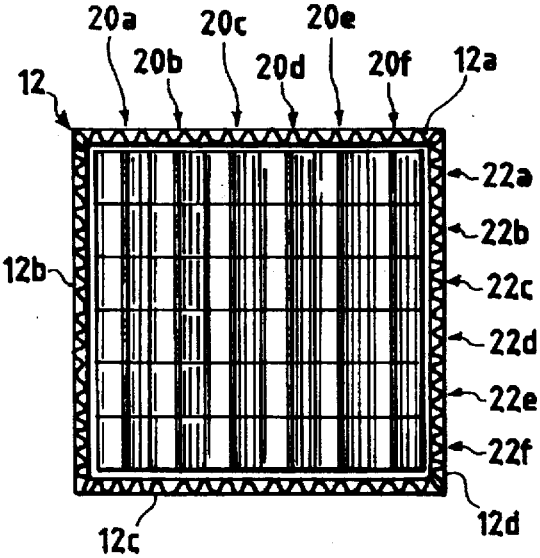
FIG. 4A
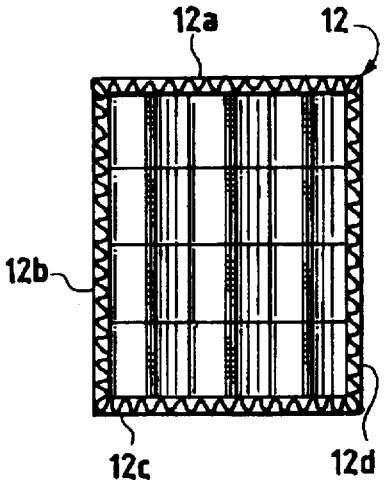
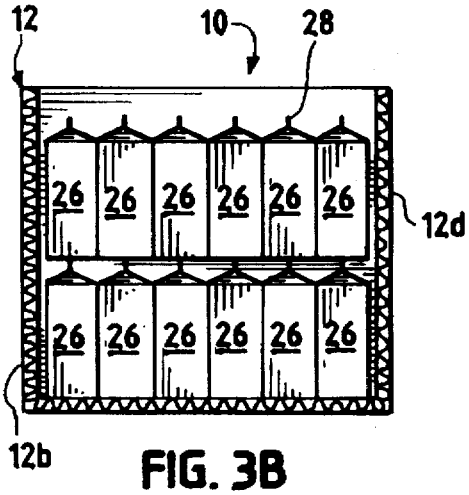
FIG. 3B
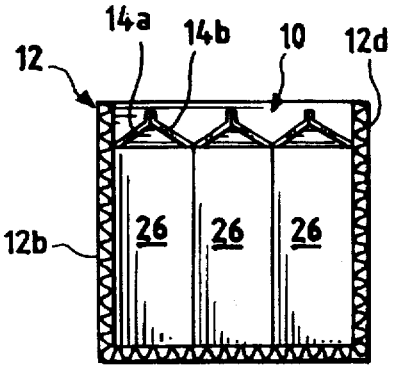
FIG. 4B

METHOD FOR CARTON PACKAGING

FIELD OF THE INVENTION

This invention relates to a method for carton packaging. More particularly, the invention relates to a method for packaging cartons, such as those used for liquid food packaging, into standard shipping and distribution units.

BACKGROUND OF THE INVENTION

In the wholesale packaging and distribution of packages, particularly carton-type packages, it is of utmost importance to properly package the goods. Proper packaging promotes economics in a number of ways. First, properly packaged cartons minimize the cost of shipping and handling by maximizing the volume of goods or material packaged into a single distribution unit. This is particularly the case in the liquid food packaging industry where properly packaged goods can provide substantial increases in the liquid food product volume carried by a standard distribution unit or crate. Second, properly packaged cartons are less likely to become damaged or otherwise unsaleable due to damage resulting from shifting and impact of the cartons during distribution and handling.

It is also important to be able to effect good packaging methods relative to marketing arrangements for such cartons. A well marketed product can further the overall sales and promotional efforts by reducing the efforts required by the end user, e.g., a supermarket stocking staff, to merchandise the goods.

Gable top cartons will be recognized by most consumers as those cartons commonly used for packaging milk, juice and the like. Gable top cartons typically have a sealed top having sloped top wall portions and a square cross-sectional shape. Common cross-sections vary between about 47 mm (about 1.85 inches) and about 95 mm (about 3.75 inches). Other common sizes are 57 mm (about 2.25 inches) and 70 mm (about 2.75 inches). Other sizes are also known to be used.

Most consumers will also recognize that often, when they remove a milk carton from a refrigerated case, it can leak or it may be damaged, having one or more corners of the carton partially crushed. Inasmuch as this can be due to improper handling of the cartons, it can also result from damage due to improper packaging of the cartons prior to and during shipping and distribution.

Distribution systems for dairy products vary between countries. For example, in the U.S., typically, standard U.S. dairy crates are used for distribution. In Holland, roll carts having racks thereon for storing cartons are used for distribution. In Japan, a different size crate standard is used for distribution. Still other distribution standards are used in other regions and countries.

For example, standard U.S. dairy crates are often packaged in a 4 by 4 array, and are thus referred to as a sixteen quart crate. It has been observed that through manipulation of the packaging and method of packaging the cartons into the distribution system, as much as eighteen liters of liquid, or almost 20 percent more liquid volume could be transported in the same distribution system.

Accordingly, there continues to be a need for a method of packaging cartons of various sizes and configurations to effect maximum efficiency in the packaging arrangements and to promote effectively marketing the goods. In such a method of packaging, an arrangement securely positions the cartons to reduce possible damage from shifting and equally distributes the weight of carton loads within a shipping unit. Such a method also effectively positions the canons with carton face portions commonly oriented.

SUMMARY OF THE INVENTION

The subject method for packaging containers of various sizes effects maximum efficiency and promotes the shipping integrity of the containers. The method further promotes marketing efforts associated with the contained product or goods. Advantageously, the present method facilitates a carton packaging arrangement in which the total liquid volume of the cartons stored in a distribution crate can be as much as 20 percent greater than known packaging arrangements, while enhancing the integrity of the cartons during shipping and handling.

The method includes providing a plurality of rectangular profile individual packages, each package having first and second pairs of parallel walls. The container pairs of walls have a length when the package is empty, defining an empty cross-sectional profile and a larger filled cross-sectional profile defined by the wall lengths when the package is filled. The packages each include a relatively rigid bottom, and a peaked gable top having a rigid, linearly disposed, upwardly extending sealing portion defined by a pair of sloped top portion walls. Each package has a pair of opposingly oriented face walls and a pair of opposingly oriented end walls between the face walls.

The method further includes providing a packing storage unit, such as a distribution crate, for storing the individual packages. The storage unit has four upstanding side walls defining an inside dimension of between about 6.6 and 6.8 times the length of one of the first and second pairs of parallel walls when the package is empty and between about 6.0 to 6.4 times the length of the walls when the package is filled. The packages are disposed in a layer within the packing storage unit and are positioned in a predetermined matrix having a first set of parallel linear arrays and a second set of parallel liner arrays. The first and second sets of linear arrays are positioned perpendicular to one another.

The packages are positioned such that the packages abut each adjacent package and abut the storage unit walls immediately adjacent to the package walls. The packages are arranged such that each of the linear sealing portions is disposed along one of the first and second set of parallel linear arrays, and the face portion of each package of each array is disposed in an orientation common with the face portion of other packages in the same array.

In a preferred arrangement, a second, upper layer of packages is disposed on the first layer of packages in an identical arrangement and orientation to the lower layer of packages. In a most preferred arrangement, the method includes the step of positioning the face portions of the upper layer of individual packages and the face portions of the lower layer of individual packages in a common orientation. The packages can be positioned with the face portions of one of the upper and lower layers of individual packages in an outwardly facing orientation. It is preferred that the face portions of both layers are positioned in an outwardly facing orientation.

Other features and advantages of the present invention will be apparent from the following detailed description, the accompanying drawings, and the appended claims.

BRIEF DESCRIPTION OF THE FIGURES

FIG. 1 illustrates a typical gable top carton having a square profile;

FIG. 2 illustrates a 3 by 2 matrix of the gable top cartons of FIG. 1;

FIG. 3*a* is a top view of a distribution unit or crate of gable top cartons packaged in accordance with the principles of the present invention, illustrated packaged in two layers of a 6 by 6 matrix;

FIG. 3*b* is a side view of the distribution crate of FIG. 3*a* shown with a side wall removed for clarity of illustration of the cartons therein, and as viewed from the side wall perspective of the encased cartons;

FIG. 4*a* is a top view of a distribution crate similar to FIG. 3*a*, illustrating cartons packaged in a 3 by 4 matrix; and FIG. 4*b* is a side view of the distribution crate of FIG. 4*a*.

DETAILED DESCRIPTION OF THE PREFERRED EMBODIMENTS

While the present invention is susceptible of embodiment in various forms, there is shown in the drawings and will hereinafter be described a presently preferred method with the understanding that the present disclosure is to be considered an exemplification of the invention and is not intended to limit the invention to the specific method described and illustrated.

Referring now to the figures, and in particular to FIGS. 3 and 4, there is shown an arrangement of individual cartons or packages 10 packaged in distribution or packing units, such as the exemplary crates 12. Crates 12 are commonly used in the dairy industry in the U.S. and most other countries for wholesale distribution of liquid food products. Crate 12 dimensions may, however, vary depending upon the standard selected in the country of origin of the crate 12.

For example, crates 12 that are found in the U.S. typically have interior dimensions of about 308 mm by 308 mm or about 320 mm by 320 mm. Distribution crates 12 used in Japan commonly have interior dimensions of about 290 mm by 255 mm. Other crate 12 sizes and standards have been established in other regions and countries.

Inasmuch as the crates 12 are commonly referred to as "dairy" or "milk" crates, they are also used in packaging, for example, juices, such as orange and grapefruit juice, and the like. During the packaging process, once the crates 12 are filled with containers or cartons, they are placed into a distribution system or network though which the products are ultimately shipped to sellers, such as supermarkets.

There are various types of cartons in use in the food packaging industry. One of the most common types of carton is the gable top carton 10, best seen in FIG. 1. It is so called because of the gable shaped top or spout portion 14 of the container 10. The carton 10 includes a rigid bottom wall 11 and a gable shaped top 14 which is defined by a pair of sloped or inclined top-side portions 14*a,b*. The inclined top-side portions 14*a,b* meet in an upstanding, linear, sealed top portion 16 of the container 10.

It is common practice to form a pour spout from an opening in one of the ends of the gable by separating a portion of the sealed top portion 16*a* and outfolding an inner folded portion. The outfolded inner portion forms the spout. Recent developments have brought about the use of reclosable or resealable spouts 18 (one shown in FIG. 2) on the container along one of the sloped sides 14*a* of the gable. The spouts 18 are generally formed of plastic and are mounted to the container inclined top-side portion 14*a* by methods that will be recognized by those skilled in the art.

The sealed top portion 16 of the container 10 has been observed to have sufficient structural strength to support the weight of one of more like containers 10, without damage to the lower or base container 10.

Past practices were to put cartons 10 into crates 12 on an as fit basis, without consideration for packaging methods, and without consideration for the economic of such methods on the overall distribution system. However, as will be recognized by those skilled in the art, the particular methods of packaging and packaging configurations can increase the liquid volume that is transported in each distribution crate 12.

For example, in a known packaging arrangement, a crate typically has placed therein a 4 by 4 matrix (sixteen total) of one quart containers. This is referred to as a sixteen quart crate, and holds a total volume of four gallons (or about 15.14 liters) of liquid food product. It has been observed that the cartons 10 can be packaged in a stable manner, with sufficient tolerance between the container 10 and the crate walls 12*a–d* to permit the cartons 10 to fit therein, and yet sufficiently snugly fit to prevent damage to the cartons 10 from shifting.

As will be readily apparent, the present method provides a package or carton packaging arrangement in which the total volume of liquid that can be held in each distribution crate 12 is greatly increased. Such an arrangement of the cartons 10 can result in an increase in distributed volume of the crate 12 from about 15.14 liters to about 18 liters of liquid food product, an increase of almost 20 percent in the same distribution package, e.g., in the same crate 12.

It has also been observed that when the cartons 10 were packaged in this manner they could be so configured so as to assure the integrity of the distribution crate 12, as a whole, when the individual cartons 10 were arranged with the sealed top portions 16 of each container 10 aligned with one another. That is, when the arranged cartons are viewed as a matrix of, for example a 6 by 6 array, as illustrated in FIGS. 3*a–b*, the arrays, as indicated at 20*a–f*, along one side 12*a* of the crate 12 are parallel to one another and are perpendicular to the arrays, as indicated at 22*a–f*, along each adjacent side 12*b,d* of the crate 12. The sealed top portions 16 of the containers 10, those portions that define the container gables, are all aligned with one another, and are all collinear with or parallel to one of the set of arrays, such as 20*a–f*, and perpendicular to the other set of arrays 22*a–f*.

Such an aligned array 22, 24 arrangement of cartons 10 also furthers the marketing of the food product. As will be recognized by most consumers, the cartons 10 have a pair of face walls 24 opposingly oriented on the cartons 10 and a pair of end walls 26 opposingly oriented on the carton 10 between the face walls 24 (see FIG. 1, one of each wall 24, 26 being illustrated). Typically, the end walls 26 are those walls below the peaked profile of the top portion 16 and the face walls 24 are those walls adjacent to and below the sloped top wall portions 14*a,b*. The face portions 24 can include familiar product packaging advertisements, whereas the end walls 26 typically include necessary product information, such as the diary or food packager, nutritional information and the like.

When the cartons 10 are packaged in accordance with the present method, the face portions 24 of the cartons 10 will all be commonly oriented. That is, as shown in FIG. 2, the face portions 24 will all face outwardly or inwardly from a common side of the distribution crate 12. This furthers the marketing and merchandising of the food product by pre-positioning or pre-orienting the cartons 10 for placement in, for example, a refrigerated case. Moreover, the present packaging method produces a packaged distribution unit 12 from which the product is readily visible and recognizable.

In an example of the present method, as illustrated in FIGS. 3*a–b*, two layers of a 6 by 6 matrix of 47 mm by 47 mm cartons are positioned in a standard U.S. distribution crate 12. Each carton 10 has a volume of 250 mL. Thus, as will be discussed herein, a total of 72 cartons 10 stored in the crate 12 provides a total liquid volume (72 cartons×250 mL per carton) of 18 liters. This represent almost a 20 percent increase over the liquid volume of the presently used 16 quart crate (15.14 mL liquid volume).

Those skilled in the art will recognize that the 47 mm side dimension of the carton 10 is an empty carton dimension. As the carton 10 is filled, the carton 10 will bulge and the 47 mm dimension will expand or bulge to between about 50 mm to 51 mm. Thus, in a 6 by 6 matrix, in each 6 carton array, the cumulative length of filled cartons along a side of the crate 12 will be between about 300 mm and 306 mm. When the filled cartons 10 are positioned in the crate 12, the carton 10 walls abut the walls of adjacent cartons 10 and abut the walls of the crate 12 immediately adjacent to the carton 10 walls.

The empty carton profile of 47 mm by 47 mm defines a cumulative empty carton profile length of about 282 mm in a six carton 10 array. As provided previously, the six carton 10 array defines a cumulative full carton profile between about 300 mm to 306 mm. That is, the 6 carton array with the cartons empty is about 47 mm×6 cartons, or 282 mm. Likewise, the 6 carton array with the cartons filled is between about 50 mm×6 cartons and 51 mm×6 cartons, or between about 300 mm and 306 mm.

Thus, when using a 320 mm square crate 12, the crate 12 is about 6.8 times the empty carton 10 wall length and between about 6.2 to 6.4 times the full carton 10 wall length. Likewise, when a 308 mm crate 12 is used, the crate 12 is between about 6.0 to 6.2 times the filled carton 10 wall length and 6.6 times the empty carton 10 wall length.

This arrangement represents a crate 12 used area of between about 87.9 percent and 91.4 percent based upon a 320 mm square crate 12 and between about 94.9 percent and 98.7 percent based upon a 308 mm square crate 12.

In another example, as illustrated in FIGS. 4*a–b*, one layer of a 3 by 4 matrix of 95 mm by 70 mm cartons is positioned in a standard U.S. distribution crate 12. Those skilled in the art will recognize that the 95 mm and 70 mm side dimensions of the carton 10 are empty carton dimensions. As the carton 10 is filled, the carton 10 will bulge and the 95 mm dimension will expand or bulge to about 100 mm. Likewise, the 70 mm dimension will bulge to about 75 mm.

Thus, in a 3 by 4 matrix, the 70 mm 4 carton array will have a cumulative length along two parallel sides of the crate 12 of about 300 mm when the cartons are filled. Likewise, the 95 mm 3 carton array will have a cumulative length along the adjacent sides of the crate 12 of about 300 mm when the cartons are filled. This arrangement represents a used crate 12 unit floor area of about 87.9 percent when a 320 mm by 320 mm distribution crate 12 is used and about 94.9 percent when a 308 mm by 308 mm distribution crate 12 is used.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A method for container packaging including the steps of:

providing a plurality of rectangular profile individual packages, each package having first and second pairs of parallel walls each pair of walls having a length when the package is empty defining an empty cross-sectional profile and a larger filled cross-sectional profile defined by a package wall length when the package is filled, the packages having a relatively rigid bottom, and a peaked gable top having a rigid, linearly disposed, upwardly extending sealing portion defined by a pair of sloped top portion walls, the packages having a pair of opposingly oriented face walls and a pair of opposingly oriented end walls between the face walls;

providing a packing storage unit for storing the individual packages, the storage unit having four upstanding side walls defining an inside dimension, the inside dimension being between about 6.6 and 6.8 times the length of one of the first and second pairs of parallel walls when the package is empty and between about 6.0 to 6.4 times the length of the parallel walls when the package is filled;

disposing a lower layer of individual packages within the packing storage unit;

positioning the individual packages in the storage unit in a predetermined matrix having a first set of parallel linear arrays and a second set of parallel liner arrays, the first and second sets of linear arrays being perpendicular to one another, the packages being positioned in abutting relation to adjacent packages and in abutting relation to the storage unit side walls immediately adjacent thereto, the packages being positioned wherein each of the linear sealing portions is disposed along one of the first and second set of parallel linear arrays, and wherein the face portion of each package of each array is disposed in an orientation common with the face portion of other packages in the same array; and disposing an upper layer of individual packages within the packing storage unit on the first layer with the bottom of the packages of the second layer positioned on the linear sealing portions of a corresponding individual package in the lower layer; and positioning the upper layer of individual packages in the storage unit in a predetermined matrix having a first set of parallel linear arrays and a second set of parallel liner arrays, the first and second sets of linear arrays being perpendicular to one another, the packages being positioned wherein each of the linear sealing portions is disposed along one of the first and second set of parallel linear arrays, and wherein the face portion of each package of each array is disposed in an orientation common with the face portion of other packages in the same array.

2. The method for container packaging according to claim 1 including the step of positioning the face portions of the upper layer of individual packages and the face portions of the lower layer of individual packages in a common orientation.

3. The method for container packaging according to claim 2 including the step of positioning the upper and lower layers of individual packages in an outwardly facing orientation.

4. The method for container packaging according to claim 1 including the step of positioning one of the upper and lower layers of individual packages in an outwardly facing orientation.

5. A method for container packaging including the steps of:

providing a plurality of square profile individual packages, each package having an empty 47 mm by 47 mm square profile, and a filled profile between about 50 mm by 50 mm and 51 mm by 51 mm, a relatively rigid bottom, and a peaked gable top having a rigid, linearly disposed, upwardly extending sealing portion defined by a pair of sloped top portion walls, the packages having a pair of opposingly oriented face walls and a pair of opposingly oriented end walls between the face walls;

providing a packing storage unit for storing the individual packages, the storage unit having four upstanding side walls defining an inside dimension of between about 6.6 to 6.8 times a length of one of the package walls when the package is empty and 6.0 to 6.4 times a length of one of the package walls when the package is filled;

disposing a lower layer of individual packages within the packing storage unit;

positioning the individual packages in the storage unit in a 6 by 6 matrix having a first set of six parallel linear arrays and a second set of six parallel liner arrays, the first and second sets of linear arrays being perpendicular to one another, the packages being positioned in abutting relation to adjacent packages and in abutting relation to the storage unit walls immediately adjacent thereto, the packages being positioned wherein each of the linear sealing portions is disposed along one of the first and second set of parallel linear arrays, and wherein the face portion of each package of each array is disposed in an orientation common with the face portion of other packages in the same array; and disposing an upper layer of individual packages within the packing storage unit on the first layer with the bottom of the packages of the second layer positioned on the linear sealing portions of a corresponding individual package in the lower layer; and positioning the upper layer of individual packages in the storage unit in a 6 by 6 matrix having a first set of six parallel linear arrays and a second set of six parallel liner arrays, the first and second sets of linear arrays being perpendicular to one another, the packages being positioned wherein each of the linear sealing portions is disposed along one of the first and second set of parallel linear arrays, and wherein the face portion of each package of each array is disposed in an orientation common with the face portion of other packages in the same array.

6. The method for container packaging according to claim 5 including the step of positioning the face portions of the upper layer of individual packages and the face portions of the lower layer of individual packages in a common orientation.

7. The method for container packaging according to claim 6 including the step of positioning the upper and lower layers of individual packages in an outwardly facing orientation.

8. The method for container packaging according to claim 5 including the step of positioning one of the upper and lower layers of individual packages in an outwardly facing orientation.

* * * * *